United States Patent [19]

Nakamura et al.

[11] 4,363,861

[45] Dec. 14, 1982

[54] TONER TRANSFER DEVELOPMENT USING ALTERNATING ELECTRIC FIELD

[75] Inventors: Shunji Nakamura, Kawasaki; Junichiro Kanbe, Tokyo; Tsutomu Toyono, Tokyo; Tohru Takahashi, Tokyo; Yasuyuki Tamura, Kawasaki, all of Japan

[73] Assignee: Canon Kabushiki Kaisha, Tokyo, Japan

[21] Appl. No.: 124,913

[22] Filed: Feb. 26, 1980

[30] Foreign Application Priority Data

Mar. 6, 1979 [JP] Japan ..... 54-25922
Mar. 6, 1979 [JP] Japan ..... 54-25923

[51] Int. Cl.[3] ..... G03G 13/08

[52] U.S. Cl. ..... 430/97; 430/120; 430/122; 430/103; 430/117; 204/DIG. 8; 355/3 DD; 355/3 TE

[58] Field of Search ..... 430/120, 122, 97, 103; 264/24; 209/222, 164; 204/180 R, DIG. 8; 355/3 DD, 3 TE; 118/654, 657

[56] References Cited

U.S. PATENT DOCUMENTS 3,645,770 2/1972 Flint ..... 430/122
4,076,857 2/1978 Kasper et al. ..... 430/122

*Primary Examiner*—John D. Welsh
*Attorney, Agent, or Firm*—Fitzpatrick, Cella, Harper & Scinto

[57] ABSTRACT

The present invention provides a developing method for rendering a latent image supported on an image bearing member visible, and an apparatus therefor, in which a developer supporting member supporting thereon spherical granular developer prepared in substantially spherical form by a flow coater process or a spray drying process is maintained in opposed relation to an electrostatic image bearing member having a backing electrode so that the surface of the image bearing member and the developer on the developer supporting member are maintained in a mutually contact-free state, and an alternating voltage is applied to the developer supporting member to cause reciprocating motion of the developer in the developing area between the developer supporting member and the image bearing member.

14 Claims, 13 Drawing Figures

TONER TRANSFER DEVELOPMENT USING ALTERNATING ELECTRIC FIELD

BACKGROUND OF THE INVENTION

1. Field of the Invention

This invention relates to a developing method for developing a latent image by the use of a developer and an apparatus therefor, and more particularly to a developing method using a one-component developer, especially a developing method which enables obtainment of fogless visible images excellent in sharpness and tone reproduction, and an apparatus therefor.

2. Description of the Prior Art

Various types of developing methods using a one-component developer are heretofore known such as the powder cloud method which uses toner particles in cloud condition, the contact developing method in which a uniform toner layer formed on a toner supporting member comprising a web or a sheet is brought into contact with an electrostatic image bearing surface to effect development, and the magnedry method which uses a conductive magnetic toner formed into a magnetic brush which is brought into contact with the electrostatic image bearing surface to effect development.

Among the above-described various developing methods using one-component developer, the powder could method, the contact developing method and the magnedry method are such that the toner contacts both the image area (the area to which the toner should adhere) and the non-image area (the background area to which the toner should not adhere) and therefore, the toner more or less adheres to the non-image area as well, thus unavoidably creating the so-called fog.

To avoid such fog or bachground toner deposition, there has been proposed the transfer development with space between toner donor member and image bearing member in which a toner layer and an electrostatic image bearing surface are disposed in opposed relationship with a space gap therebetween in a developing process so that the toner is caused to fly to the image area by the electrostatic field thereof and the toner does not contact the non-image area. Such development is disclosed, for example, in U.S. Pat. Nos. 2,803,177; 2,758,525; 2,838,997; 2,839,400; 2,862,816; 2,996,400; 3,232,190 and 3,703,157. This development is a highly effective method in preventing the fog. Nevertheless, the visible image obtained by this method generally suffers from the following disadvantages because it utilizes the flight of the toner resulting from the electric field of the electrostatic image during the development.

A first disadvantage is the problem that the sharpness of the image is reduced at the edges of the image. The state of the electric field of the electrostatic image at the edge thereof is such that if an electrically conductive member is used as the developer supporting member, the electric lines of force which emanate from the image area reach the toner supporting member so that the toner particles fly along these electric lines of force and adhere to the surface of the photosensitive medium, thus effecting development in the vicinity of center of the image area. At the edges of the image area, however, the electric lines of force do not reach the toner supporting member due to the charge induced at the non-image area and therefore, the adherence of the flying toner particles is very unreliable and some of such toner particles barely adhere while some of the toner particles do not adhere. Thus, the resultant image is an unclear one lacking sharpness at the edges of the image area, and line images, when developed, give an impression of having become thinner than the original lines.

To avoid this in the above-described toner transfer development, the clearance between the electrostatic image bearing surface and the developer supporting member surface must be sufficiently small (e.g. smaller than 100μ) and actually, accidents such as pressure contact of the developer and mixed foreign substances are liable to occur between the two surfaces. Also, maintaining such a fine clearance often involves difficulties in designing of the apparatus.

A second problem is that images obtained by the above-described toner transfer development usually lack tone gradation. In the toner transfer development, the toner does not fly until the toner overcomes the binding power to the toner supporing member by the electric field of the electrostatic image. This power which binds the toner to the toner supporting member is the resultant force of the Van der Waals force between the toner and the toner supporting member, the force of adherence among the toner particles, and the reflection force between the toner and the toner supporting member resulting from the toner being charged. Therefore, flight of the toner takes place only when the potential of the electrostatic image has become greater than a predetermined value (hereinafter referred to as the transition threshold value of the toner) and the electric field resulting therefrom has exceeded the afore-mentioned binding force of the toner, whereby adherence of the toner to the electrostatic image bearing surface takes place. But the binding power of the toner to the supporting member differs in value from particle to particle or by the particle diameter of the toner even if the toner has been manufactured or prepared in accordance with a predetermined prescription, and therefore, it is considered to be distributed narrowly around a substantially constant value and correspondingly, the threshold value of the electrostatic image surface potential at which the flight of toner takes place also seems to be distributed narrowly around a certain constant value. Such presence of the threshold value during the flight of the toner from the supporting member causes adherence of the toner to that part of the image area which has a surface potential exceeding such threshold value, but causes little or no toner to adhere to that part of the image area which has a surface potential lower than the threshold value, with a result that there are only provided images which lack the tone gradation having steep $\gamma$ (the gradient of the characteristic curve of the image density with respect to the electrostatic image potential).

In view of such problems, a developing device in which a pulse bias of very high frequency is introduced across an air gap to ensure movement of charged toner particles flying through the air gap, whereby the charged toner particles are made more readily available to the charged image is disclosed in U.S. Pat. Nos. 3,866,574; 3,890,929 and 3,893,418.

Such high frequency pulse bias developing device may be said to be a developing system suitable for the line copying in that a pulse bias of several KHz or higher is applied in the clearance between the toner donor member and the image retaining member to improve the vibratory characteristic of the toner and prevent the toner from reaching the non-image area in any pulse bias phase but cause the toner to transit only to the image area, thereby preventing fogging of the non-image area. However, the aforementioned U.S. Pat. No. 3,893,418 states that a very high frequency (18 KHz–22 KHz) is used for the applied pulse voltage in order to make the device suitable for the reproduction of tone gradation of the image.

U.S. Pat. No. 3,346,475 discloses a method which comprises immersing two electrodes in insulating liquid contained in a dielectrophoretic cell and applying thereto an AC voltage of very low frequency (lower than about 6 Hz) to thereby effect the development of a pattern corresponding to the conductivity variance.

Further, U.S. Pat. No. 4,014,291 discloses a method in which dry, one component magnetic toner on the non-magnetic, non-conductive transfer cylinder which encloses a rotating cylindrical magnet is transferred to the deposit zone to develop an electrostatic latent image on coated paper, but this patent does not suggest that a bias is applied for the above-described purpose.

Also a developing method improved by the present assignee is disclosed in the U.S. patent application Ser. Nos. 58,434 and 58,435.

SUMMARY OF THE INVENTION

The object of the present invention is to provide a developing method not associated with above-mentioned drawbacks and capable of achieving a reduced fog in the non-image area and an improved tonal rendition.

Another object of the present invention is to provide a developing method and an apparatus therefor, in which a developer supporting member supporting thereon a developer of substantially spherical particles is maintained in non-contact opposed relationship to latent image bearing member to form a clearance therebetween, and an alternating voltage is applied to said developer supporting member to cause reciprocating motion of the developer in the space between said latent image bearing member and said developer supporting member thereby developing said latent image.

Still another object of the present invention is to provide a developing method and an apparatus therefor, in which a low-frequency electric field of a frequency not exceeding 1 kHz is applied as the aforementioned alternating voltage.

Still another object of the present invention is to provide a developing method and an apparatus therefor, satisfying a condition:

$$0.3 \times Vp \leqq f \leqq 1500$$

wherein Vp is the peripheral speed of said latent image bearing member in millimeters per second, and f is the frequency of said alternating electric field in Hz, and utilizing microcapsule toner as the aforementioned developer.

Still another object of the present invention is to provide a developing method and an apparatus therefor for developing a latent image by forming a layer of the aforementioned spherical magnetic toner on a non-magnetic rotary member encircling a magnetic roll and maintaining said rotary member in opposed relationship to a latent image bearing member with a clearance therebetween, wherein a repulsive magnetic field is formed in said opposed area and alternating electric field is applied in said clearance.

Still another object of the present invention is to provide a developing apparatus having a rotary non-magnetic sleeve provided to encircle a fixed permanent magnet therein and bearing a toner layer thereon formed by toner applying means, said sleeve being maintained in the developing area at a clearance to the latent image bearing member larger than the thickness of said toner layer, and an alternating electric field being applied across said clearance, wherein a magnetic field component parallel to the surface of said sleeve is provided in said developing area.

In short, the present invention is featured by a developing method for rendering a latent image supported on an image bearing member visible, and an apparatus therefor, in which a developer supporting member supporting thereon spherical granular developer prepared in substantially spherical form by a flow coater process or a spray drying process is maintained in opposed relation to an electrostatic image bearing member having a backing electrode so that the surface of the image bearing member and the developer on the developer supporting member are maintained in a mutually contact-free state, and alternating electric field is applied to the developer supporting member to cause reciprocating motion of the developer in the developing area between the developer supporting member and the image bearing member thereby rendering the latent image visible.

The present invention is advantageous in that:

(i) an alternating electric field is applied across a small developing clearance to cause alternate transition and back transition of the developer, thereby providing a visible image rich in tonal rendition:

(ii) the presence of the above-mentioned back transition stage suppresses the background fog to a practically negligible level:

(iii) the developer is captured in the circumferential electric field in the above-mentioned transition stage to achieve a sharp line image:

(iv) the use of spherical developer particles with improved fluidity ensures satisfactory and uniform frictional charging on the developer supporting member, allowing easy and uniform cleavage of said particles from the supporting member in the above-mentioned transition phase and thus providing a visible image faithful to the latent image:

(v) the use of a repulsive magnetic field allows easy release of the magnetic toner from the toner supporting member, and the presence of the alternating bias electric field working on thus released toner facilitates the toner movement, particularly enhancing the reciprocating motion thereof between the latent image bearing member and the toner supporting member:

(vi) the repulsive magnetic field and the positive phase of the alternating bias field cooperate each other to generate a kind of toner cloud and the edge effect at the end portions of the latent image intensifies the visible image development at said end portions, thereby ensuring obtainment of a clear line image.

Still other objects, fearures and advantages of the present invention will be made apparent from the following detailed description of the preferred embodiments of the present invention to be taken in conjunction with the attached drawings.

DESCRIPTION OF THE PREFERRED EMBODIMENTS

The principle of the developing method utilized in the present invention will be described by reference to FIG. 1. In the lower portion of FIG. 1, there is shown a voltage waveform applied to a toner carrier. It is shown as a rectangular wave, whereas it is not restricted thereto. A bias voltage of the negative polarity having a magnitude of Vmin is applied at a time interval t1, and a bias voltage of the positive polarity having a magnitude of Vmax is applied at a time interval t2. When the image area charge formed on the image surface is positive and this is developed by negatively charged toner, the magnitudes of Vmin and Vmax are selected so as to satisfy the relation that $$\text{Vmin} < V_L < V_D < \text{Vmax} \quad (1)$$

where $V_D$ is the image area potential and $V_L$ is the non-image area potential. If so selected, at the time interval t1, the bias voltage Vmin acts to impart a bias field with a tendency to expedite the contact of toner with the image area and non-image area of an electrostatic latent image bearing member and this is called the toner transition stage. At the time interval t2, the vias voltage Vmax acts to impart a bias field with a tendency to cause the toner which as transited to the latent image bearing surface in the time interval t1 to be returned to the toner carrier and this is called the back transition stage.

Figure 1:
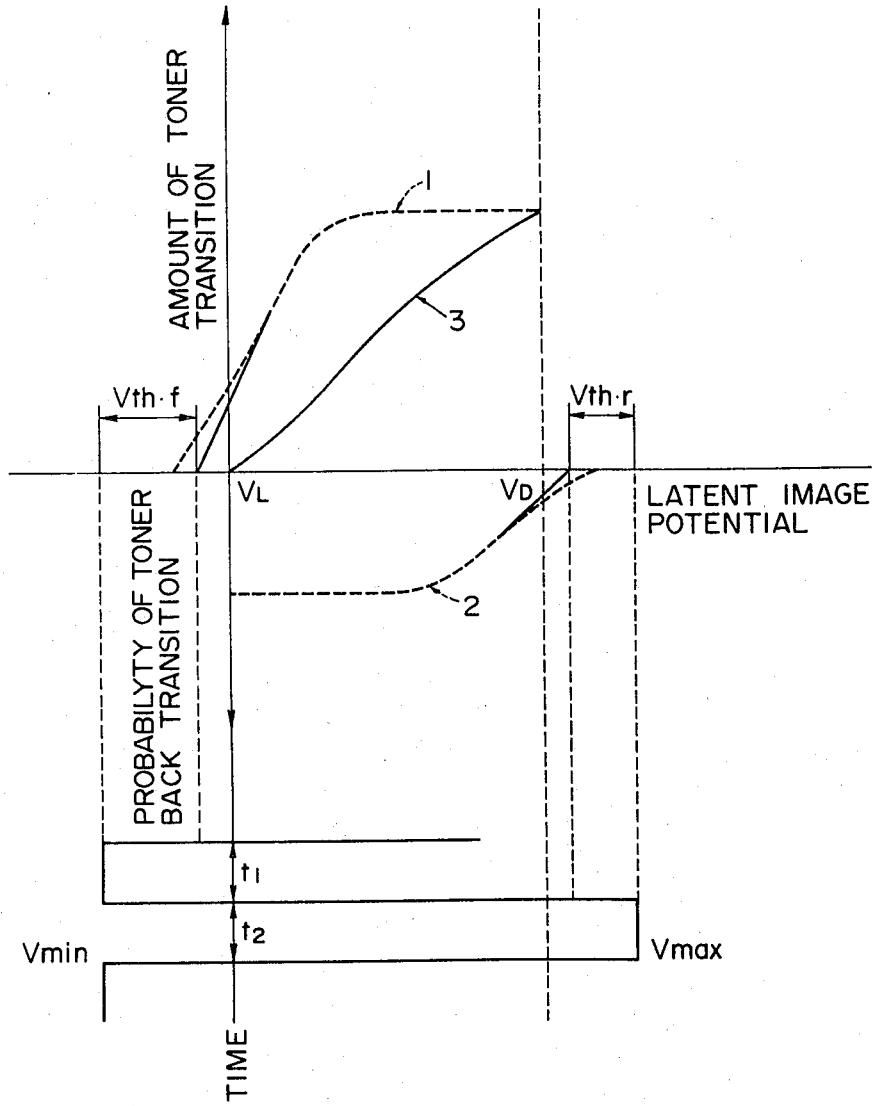
FIG. 1 illustrates the amount of transition of the toner and the characteristic of the degree of toner back transition for the potential of a latent image, as well as an example of the voltage waveform applied.

Vth·f and Vth·r in FIG. 1 are the potential threshold values at which the toner transits from the toner carrier to the latent image surface or from the latent image surface to the toner carrier, and may be considered potential values extrapolated by a straight line from the points of the greatest gradient of the curves shown in the drawing. In the upper portion of FIG. 1, the amount of toner transition at t1 and the degree of toner back transition at t2 are plotted with respect to the latent image potential.

The amount of toner transition from the toner carrier to the electrostatic image bearing member in the toner transition stage is such as curve 1 shown by broken line in FIG. 1. The gradient of this curve is substantially equal to the gradient of the curve when no bias alternate voltage is applied. This gradient is great and the amount of the toner transition tends to be saturated at a value intermediate $V_L$ and $V_D$ and accordingly, it is not suited for reproduction of half-tone images and provides poor tone gradation. Curve 2 indicated by another broken line in FIG. 1 represents the probability of toner back transition.

In the developing method utilized in the present invention, an alternating electric field is imparted so that such toner transition stage and toner back transition stage may be alternately repeated and in the bias phase t1 of the toner transition stage of that alternating electric field, toner is positively caused to temporally reach the non-image area of the electrostatic latent image bearing member from the toner carrier (of course, toner is also caused to reach the image area) and toner is sufficiently deposited also on the half-tone potential portion having a low potential approximate to the light region potential $V_L$, whereafter in the bias phase t2 of the toner back transition stage, the bias is caused to act in the direction opposite to the direction of toner transition to cause the toner which has also reached the non-image portion as described to be returned to the toner carrier side. In this toner back transition stage, as will later be described, the non-image area does not substantially have the image potential originally and therefore, when a bias field of the opposite polarity is applied, the toner which has reached the non-image area as described tends to immediately leave the non-image area and return to the toner carrier. On the other hand, the toner once deposited on the image area including the half-tone area is attracted by the image area charge and therefore, even if the opposite bias is applied in the direction opposite to this attracting force as described, the amount of toner which actually leaves the image area and returns to the toner carrier side is small. By so alternating the bias fields of different polarities at a preferred amplitude and frequency, the above-described transition and back transition of the toner are repeated a number of times at the developing station. Thus, the amount of toner transition to the latent image surface may be rendered to an amount of transition faithful to the potential of the electrostatic image. That is, there may be provided a developing action which may result in a variation in amount of toner transition having a small gradient and substantially uniform from $V_L$ to $V_D$ as shown by curve 3 in FIG. 1. Accordingly, practically no toner adheres to the non-image area while, on the other hand, the adherence of the toner to the half-tone image areas takes place corresponding to the surface potential thereof, with a result that there is provided an excellent visible image having a very good tone reproduction. This tendency may be made more pronounced by setting the clearance between the electrostatic latent image bearing member and the toner carrier so that it is greater toward the termination of the developing process and by decreasing and converging the intensity of the above-mentioned electric field in the developing clearance.

Figure 2:
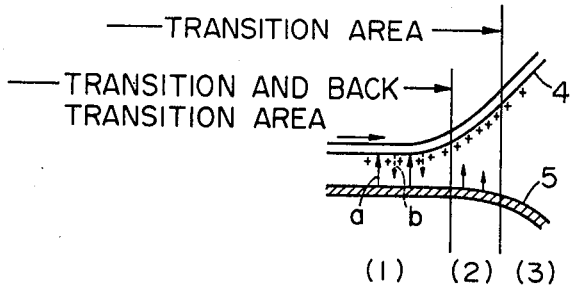
FIGS. 2 and 3 illustrate the process of the developing method utilized in the present invention.
Figure 3:
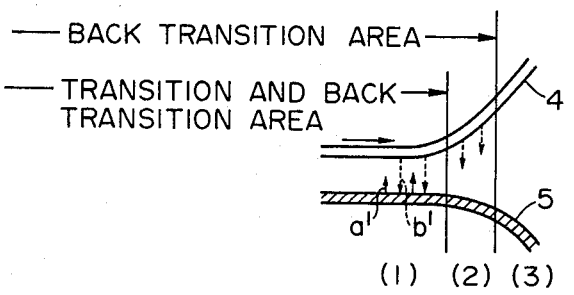
Figure 4:
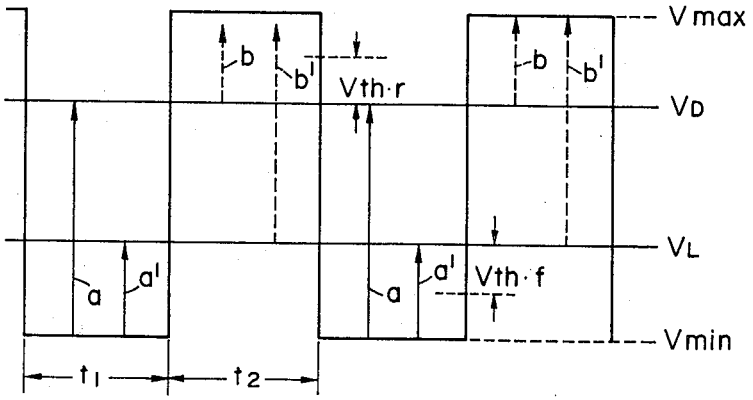
FIG. 4 shows an example of the applied voltage waveform.

An example of such developing process utilized in the present invention is shown in FIGS. 2 and 3. As shown in FIGS. 2 and 3, the electrostatic image bearing member 4 is moved in the direction of arrow through developing regions (1) and (2) to a region (3). Designated by 5 is a toner carrier. Thus, the electrostatic image bearing surface and the toner carrier gradually widen the clearance therebetween from their most proximate position in the developing station. FIG. 2 shows the image area of the electrostatic image bearing member and FIG. 3 shows the non-image area thereof. The direction of arrows shows the direction of the electric fields and the length of the arrows indicates the intensity of the electric fields. It is important the electric fields for the transition and back transition of the toner from the toner carrier are present also in the non-image area. FIG. 4 shows a rectangular wave which is an example of the waveform of the alternate current applied to the toner carrier, and schematically depicts, by arrows in the rectangular wave, the relation between the direction and intensity of the toner transition and back transition fields. The shown example refers to the case where the electrostatic image charge is positive, whereas the invention is not restricted to such case. When the electrostatic image charge is positive, the relations between the image area potential $V_D$, the non-image area potential $V_L$ and the applied voltages Vmax and Vmin are set as follows:

$$\left.\begin{array}{l}|V_{max} - V_L| > |V_L - V_{min}| \\ |V_{max} - V_D| < |V_D - V_{min}|\end{array}\right\} \quad (2)$$

In FIGS. 2 and 3, a first process in the development occurs in the region (1) and a second process occurs in the region (2). In the case of the image area shown in FIG. 2A, in the region (1), both of the toner transition field a and the toner back transition field b are alternately applied correspondingly to the phase of the alternate field and the transition and back transition of the toner result therefrom. As the developing clearance becomes greater, the transition and back transition fields become weaker and the toner transition is possible in the region (2) while the back transition field sufficient to cause the back transition (below the threshold value $|V_{th}\cdot\gamma|$) becomes null. In the region (3), the transition neither takes place any longer and the development is finished.

In the case of the non-image area shown in FIG. 3, in the region (1), both the toner transition field a' and the toner back transition field b' are alternately applied to create the transition and back transition of the toner. Thus, fog is created in this region (1). As the clearance is wider, the transition and the back transition field become weaker and when the region (2) is entered, the toner back transition is possible while the transition field sufficient to cause transition (below the threshold value) becomes null. Thus, in this region, fog is not substantially created and the fog created in the region (1) is also sufficiently removed in this stage. In the region (3), the back transition neither takes place any longer and the development is finished. As regards the half-tone image area, the amount of toner transition to the final latent image surface is determined by the magnitudes of the amount of toner transition and the amount of toner back transition corresponding to that potential, and after all, there is provided a visible image having a small gradient of curve between the potentials $V_L$ to $V_D$, as shown by curve 3 in FIG. 1, and accordingly having a good tone gradation.

In this manner the toner is caused to fly over the developing clearance and is caused to temporarily reach the non-image area as well to improve the tone gradation, and in order that the toner having reached the non-image area may be chiefly stripped off toward the toner carrier, it is necessary to properly select the amplitude and alternating frequency of the alternate bias voltage applied. Results of the experiment in which the effect of the present invention has clearly appeared by such selection described with the embodiments.

It is found that when no bias field is applied, the gradient or so-called value of the V-D curves is very great but by applying an alternate field of low frequency, the $\gamma$ value is made smaller to greatly enhance the tone gradation. As the frequency of the extraneous field is increased from 100 Hz, the $\gamma$ value becomes gradually greater to reduce the effect of enhancing the harmony and, when the clearance is 100$\mu$ and when the frequency exceeds 1 KHz under the amplitude $V_{p-p}$=800 V, that effect becomes weak; when the clearance is 300$\mu$ and when the frequency reaches the order of 800 Hz, that effect is also reduced; and when the frequency exceeds 1.5 KHz, the effect of harmony becomes weak. This may be considered to be attributable to the following reason. In the developing process during which an alternate field is applied, when the toner repeats adherence and separation in the clearance between the sleeve surface and the latent image formation surface, finite time is necessary to positively effect the reciprocating movement thereof. Particularly, the toner which transits by being subjected to a weak electric field takes a relatively long time to positively effect the transition.

An electrostatic field exceeding a threshold value which will cause transition of the toner is produced from the half-tone image area, but the electrostatic field is relatively weak. To cause the toner to reach the half-tone image area, it is necessary that the toner particles moved relatively slowly by being subjected to the electrostatic field positively transit to the image area within one-half period of the applied alternate field. For this purpose, where the amplitude of the alternate field is constant, a lower frequency of the alternate field is more advantageous and accordingly, a particularly good tone gradation is provided for an alternate field of low frequency. The $\gamma$ value becomes considerably great for the order of 800 Hz and when 1.5 KHz is exceeded, the $\gamma$ value becomes almost equal to that when no alternate voltage is applied. Therefore, in order to obtain the same effect of enhanced tone reproduction as that when the clearance is narrow, it is preferable to reduce the frequency as will later be described or to increase the intensity (amplitude) of the alternate voltage.

On the other hand, too low a frequency does not result in sufficient repetition of the reciprocating movement of the toner during the time the latent image formation surface passes through the developing station, and tends to cause irregular development to be created in the image by the alternate voltage. As the result of the experiment, generally good images have been provided down to the frequency of 40 Hz, and when the frequency is below 40 Hz, irregularity has been created in the visible image. It has been found that the lower limit of the frequency for which no irregularity is created in the visible image depends on the developing conditions, above all, the developing speed (also referred to as the process speed, $V_p$ mm/sec.). In the present experiment, the velocity of movement of the electrostatic image formation surface has been 110 mm/sec. and therefore, the lower limit of the frequency is $40/110\times V_p \approx 0.3\times V_p$. As regards the waveform of the alternate voltage applied, it has been confirmed that any of sine wave, rectangular wave, sawtooth wave or asymmetric wave of these is effective.

Such application of the alternate bias, of lower frequency brings about remarkable enhancement of the tone gradation, but the voltage value thereof must be properly set. That is, too great a value for the |Vmin| of the alternate bias may result in an excessive amount of toner adhering to the non-image area during the toner transition stage and this may prevent sufficient removal of such toner in the developing process, which in turn may lead to fog or stain created in the image. Also, too great a value for |Vmax| would cause a great amount of toner to be returned from the image area, thus reducing the density of the so-called solid black portion. To prevent these phenomena and to sufficiently enhance the tone gradation, Vmax and Vmin may preferably and reasonably be selected to the following degrees:

$$V\max \approx V_D + |\mathrm{Vth}\cdot\gamma| \quad (3)$$

$$V\min \approx V_L + |\mathrm{Vth}\cdot f| \quad (4)$$

Vth·f and Vth·γ are the potential threshold values already described. If the voltage values of the alternate bias are so selected, the excess amount of toner adhering to the non-image area in the toner transition stage and the excessive amount of toner returned from the image area in the back transition stage would be prevented to ensure obtainment of proper development.

When the developing clearance d is relatively great like this, it is advisable to provide a greater value of the $V_{p-p}$ of the applied voltage and providing a higher value for f than when the developing clearance d is small.

In order to provide enhanced tone gradation of the image, it is necessary to set the alternating frequency and amplitude value of the applied alternate voltage to proper ranges, and it has been found that, depending on the properties of the image, the relation between the frequency and amplitude value of the applied voltage may be selectively changed over within an appropriate range. That is, when the relation between the frequency and the voltage value of the alternate voltage are studied more strictly, it has become clear that the developing characteristic (V-D curves) can be selected arbitrarily by those values.

The foregoing description has been made with respect to the case where the image area potential VD is positive, whereas the present invention is not restricted thereto but it is also applicable to a case where the image are a potential is negative and in this latter case, if the positive of the potential is small and the negative of the potential is great, the present invention is equally applicable. Therefore, when such image area charge is negative, the aforementioned formulas (1)–(4) are represented as the following formulas (1')–(4').

$$\mathrm{Vmax} > VL > VD > \mathrm{Vmin} \quad (1')$$

$$\left.\begin{array}{l} |\mathrm{Vmin} - VL| > |VL - \mathrm{Vmax}| \\ |\mathrm{Vmin} - VD| < |VL - \mathrm{Vmax}| \end{array}\right\} \quad (2')$$

$$\mathrm{Vmin} \approx VD - |Vth \cdot \gamma| \quad (3')$$

$$\mathrm{Vmax} \approx VL + |Vth \cdot f| \quad (4')$$

The present invention utilizes a developer composed of spherical particles. Such spherical developer is advantageous in providing a higher fluidity, acquiring uniform charge by an improved frictional charging on the developer supporting member, and being less subjected to uneven force such as the Van der Waals force because of reduced contact areas with the developer supporting member or the image bearing member, thus ensuing uniform and easy cleavage from the developer supporting member in the transition stage and from the image bearing member in the back transition stage and thus providing a satisfactory visible image rich in tonal rendition with extremely reduced developer deposition on the non-image area.

The developer of spherical particles to be employed in the present invention can be prepared by various methods. An example of such methods is so-called spray drying method a kneaded mixture of resin, pigment, charge regulant (and magnetic powder in case of a magnetic developer) is dissolved in a solvent and pulverized from a nozzle into heated air to evaporate the solvent from the surface of thus pulverized particles and simultaneously to form spherical particles by the surface tension of the solvent during said evaporation.

Another example is called flow coater method in which the developer particles in the powdered state are blown into hot air to melt the resin present on the surface of said particles and to form spherical particles by the surface tension of thus molten resin.

Further, in a simpler method the spherical particles can be obtained by agitating the developer particles in hot water to soften said particles, followed by filtration and drying.

The above-mentioned methods for forming spherical particles are also applicable to the microcapsule toner composed of a well fixable core material covered with a shell resin as disclosed in the Japanese Patent Publications Sho No. 49-1588 and Sho No. 51-35867.

In the following there will be shown the embodiments of the present invention.

EMBODIMENT 1

An electrostatic latent image having a dark potential of ca. 500 V and a light potential of ca. 0 V respectively corresponding to the dark and lighted areas of an image was formed on a photosensitive member of a three-layered structure composed of a backing electrode, a CdS photoconductive layer and an insulating layer.

Figure 5:
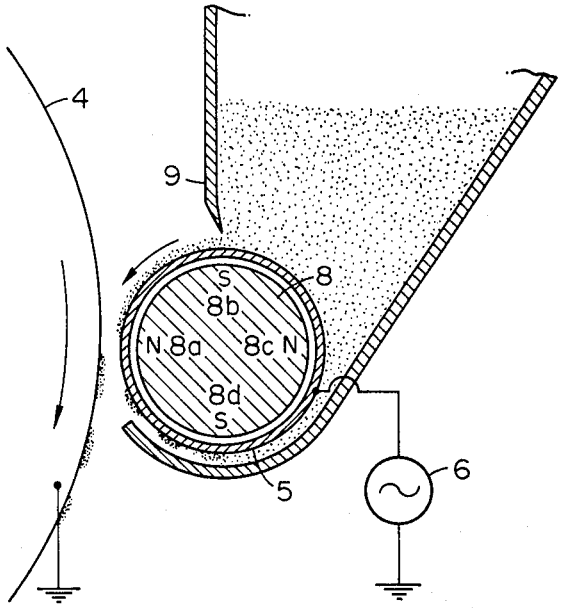
FIGS. 5 and 6 are cross-sectional views showing an example of the embodiment of the present invention.
Figure 6:
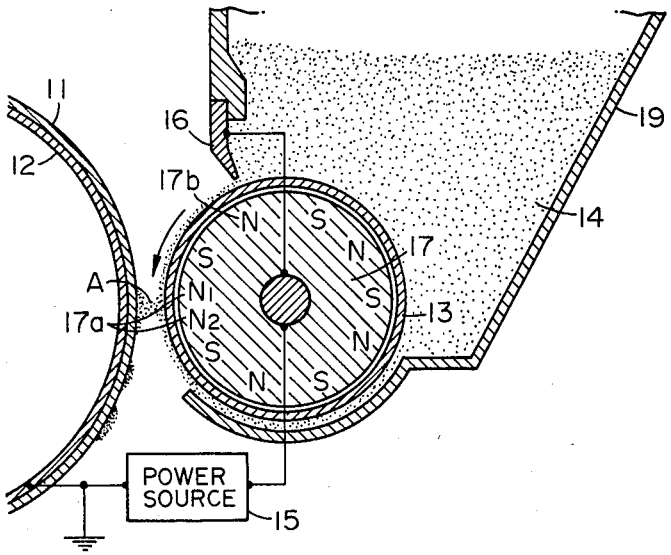

A photosensitive drum of a diameter of 80 mm bearing the above-mentioned electrostatic pattern on the surface thereof was rotated at a peripheral speed of 110 mm/sec, and the developing unit employed was as shown in FIG. 5.

In the illustrated developing unit, a non-magnetic cylinder (hereinafter called sleeve) 5 of a diameter of 30 mm was rotated in the direction of arrow with a same peripheral speed as that of the photosensitive drum positioned with a clearance of 300 microns between the surfaces thereof.

8 illustrates magnetic field generating means fixedly provided in the sleeve 5, in which 8*a* is a developing magnetic pole positioned in the developing area in facing relation to the photosensitive drum and adapted to generate a flux density of 750 gauss on the surface of the sleeve while 8*b* is a magnetic pole of 800 gauss positioned in facing relation to a toner thickness defining member 9 which functions to define the thickness of the toner layer maintained in vertically spiked state in the vicinity of said magnetic pole. Said defining member 9 is spaced from the surface of the sleeve 5 by a distance of 150 microns to maintain the toner layer at a thickness smaller than the clearance between the photosensitive drum 4 and the sleeve 5. It is also possible to employ a magnetic defining member 9 for defining the toner layer thickness by means of a converting magnetic field, as disclosed for example in the U.S. patent application Ser. No. 938,494. 8*c* and 8*d* are magnetic poles for transporting the developer.

In order to provide the sleeve 5 with an alternating electric field, an AC bias voltage of 800 V (peak-to-peak) with a frequency of 200 Hz overlapped with a DC voltage of 200 V was supplied from a power source 6. A one-component magnetic toner composed of a mixture in 3:1 weight ratio of pressure-fixable polyethylene and magnetite and prepared into spherical particles of a mean diameter of 10 microns by dispersing said mixture in xylene and spraying thus obtained dispersion into hot air of 130° C. by spray drying method was employed in the developing unit explained above to obtain a fog-free image with excellent tonal rendition.

EMBODIMENT 2

A microcapsule toner explained in the following was employed in the development of an electrostatic latent image in combination with the photosensitive member and the developing unit described in the foregoing Embodiment 1 to obtain a satisfactory result.

The core material of the microcapsule toner was prepared by kneading 3 parts by weight of polyethylene and 1 part by weight of magnetite on a roll mill at 150° C., crushing the obtained mixture and eliminating the particles smaller than 7 microns by means of a classifier.

A styrene-butadiene resin was dissolved in methylethylketone, and the above-mentioned core material was mixed therein. The polyethylene used in the core material is insoluble in methylethylketone. The mixture thus obtained was sprayed by spray drying method in hot air of 100° C. to evaporate methylethylketone thereby coating styrene-butadiene resin in spherical form on the polyethylene core material, and thus obtained microcapsule toner was employed in the above-described developing unit.

EMBODIMENT 3

Figure 7:
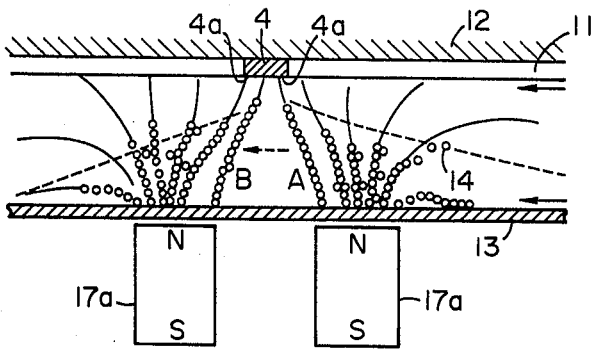
FIG. 7 is an explanatory drawing showing the working principle of the embodiment shown in FIG. 6.

In FIG. 7 there are shown a latent image bearing member 11 having an insulating layer on the surface of a CdS photosensitive member, a backing electrode 12 therefor, a non-magnetic sleeve 13, a fixed permanent magnet roll 17 provided in said sleeve, a magnetic pole 17*a* generating a repulsive magnetic field, and a magnetic toner 7 formed into spherical perticles as in the foregoing embodiments and composed of a kneaded and crushed mixture of 75% of a styrene-maleic acid resin, 20% of ferrite, 3% of carbon black and 2% of a charge regulant. 19 is a toner reservoir while 16 is a magnetic (iron) blade positioned in facing relationship to a magnetic pole 17*b* (causing a flux density of 850 gauss on the sleeve surface) of the fixed magnet roll and at a distance of 240 microns from the sleeve surface. Along with the rotation of the sleeve, the magnetic toner is applied thereon with a thickness defined by the magnetic force of the magnetic blade 16 and transported to the developing area A. In the present embodiment the applied toner layer has a mean thickness of ca. 100 microns but is enlarged to a height of ca. 200 microns at said area A where a repulsive magnetic field is formed. The latent image bearing member 1 and the sleeve 3 are maintained at a minimum clearance of 300 microns. The magnetic flux density on the sleeve surface in the vicinity of the repulsive pole is 800 gauss or 780 gauss at the pole N1 or N2 respectively and is 40 gauss between the poles N1 and N2 where the density is lowest.

15 is a power source for supplying an alternating electric field to the position A, of which output is applied to the sleeve 13 and the magnetic blade 16, while the backing electrode 2 is maintained at the grounding potential.

The latent image on the latent image bearing member 11 has potentials of ca. 500 V and ca. 0 V respectively in the image area and in the non-image area, while the applied voltage has a sinusoidal waveform of a frequency of 300 Hz with a maximum value of 670 V and a minimum value of −230 V. The latent image bearing member 11 is rotated at a peripheral speed of 110 mm/sec while the sleeve 13 is displaced in the same direction and at a substantially same speed at the developing area. The above-explained arrangement proved to provide a satisfactory visible image.

The function of the repulsive magnetic field in the present embodiment will be explained in the following in relation to FIG. 7 showing the behavior of the magnetic field and of the toner in the developing area.

In the area of a repulsive magnetic field generated by arranged magnetic poles of a same polarity as shown in FIG. 7, the toner chains 14 arranged in spike forms along the line of magnetic force are in a fully extended state, and are displaced from the position B to A along with the displacement of the non-magnetic sleeve 13 while said spikes are extended toward the latent image bearing surface of the image bearing member 11. In this area, therefore, the density of the spherical toner particles is low and the adhesion force between the particles or between the particle and the sleeve is weak so that the toner transition to the latent image bearing member takes place easily. Also the extended state of the toner chains increases the sensitivity even to the lines of electric force of the peripheral portion 4*a* of the image area 4, thus providing excellent reproducibility of a fine line. Besides the obtained image is rich in tonal rendition presumably due to a high-speed toner displacement from the position A to B.

On the other hand it is difficult to obtain a finely detailed image presumably because of the sparce density of the toner particles. Also the highly extended toner chains are apt to come into contact with the image bearing surface, thus resulting in a fog stain on the non-image area. It is however found that the application of the aforementioned alternating electric field between the backing electrode 12 and the sleeve 13 eliminates the above-mentioned drawbacks, providing a finely detailed high-quality image rich in tonal rendition and reproducibility of fine lines. The effect of said alternating electric field can be explained in the following manner.

During the passage through the developing area, the alternating electric field generates a reciprocating motion of the spherical toner particles between the sleeve and the latent image bearing member. As the result of said reciprocating motion, the toner particles once deposited in the chained form on the latent image bearing surface are decomsed and rearranged uniformly on said surface. Also the electric field allows the contribution of the toner present in a large area of the sleeve to the development, and it is rendered possible to obtain a finely detailed image by these effects. Also the fog stain formed in the non-image area by the contact of the toner chain can be removed during the inverted phase period of the alternating electric field.

EMBODIMENT 4

Figure 8:
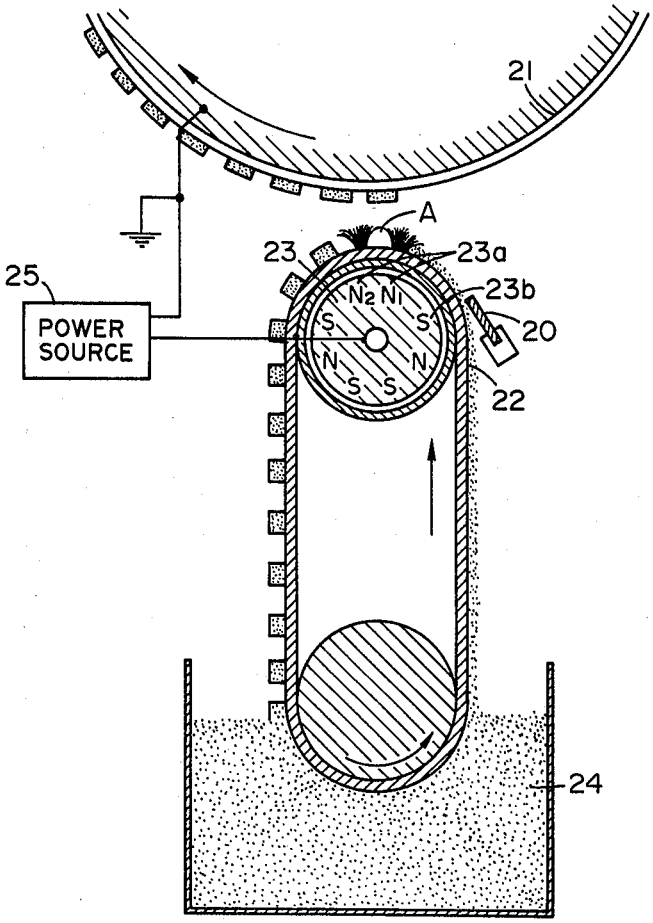
FIGS. 8, 9(A) and 9(B) are cross-sectional views showing examples of another embodiment of the present invention.

In FIG. 8 there are shown a selenium photosensitive member 21, a toner supporting member 22 made of a conductive rubber, and a toner thickness defining member 20 made of chloroprene rubber and positioned in facing relation to a magnetic pole 23*b* (flux density 1000 gauss) of a magnet roll 23 and maintained in pressure contact with said toner supporting member 22. The toner 24 is formed into spherical particles as in the foregoing embodiments and composed of a kneaded and crushed mixture of 65% of a styrene resin, 32% of magnetite and 3% of a charge regulant. The toner layer has a mean thickness of ca. 80 microns which is extended to a maximum of ca. 160 microns in the developing area by the function of a repulsive magnetic pole 23*a*. The toner supporting member 22 is spaced, in the developing area, from the image bearing member 21 by a distance of ca. 200 microns. The magnetic flux density caused by the repulsive magnetic poles 23*a* in the developing area is 1000 gauss at N1 or 960 gauss at N2 and is 600 gauss between N1 and N2 where the density is lowest. The latent image has potential of 600 V and 50 V respectively in the image area and in the non-image area. A power supply 25 provides an alternating square-wave voltage with a frequency of 400 Hz and with a maximum value of −300 V. The photosensitive member 21 is rotated at a peripheral speed of 200 mm/sec and the toner supporting member 22 is displaced in a same direction at a peripheral speed of 193 mm/sec. A satisfactory image was obtained by the above-explained arrangement.

The following embodiment provides a developing device particularly adapted for line reproduction by forming a magnetic field component parallel to the surface of the developer supporting member or sleeve in a developing area thereof close to the image bearing member.

EMBODIMENT 5

Figure 9A:
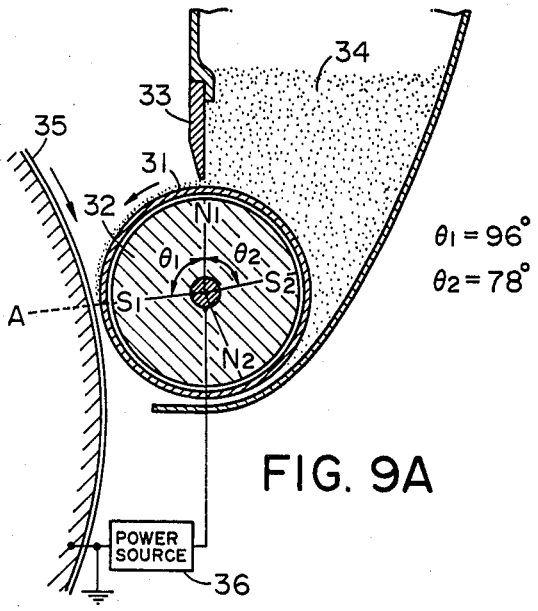
Figure 9B:
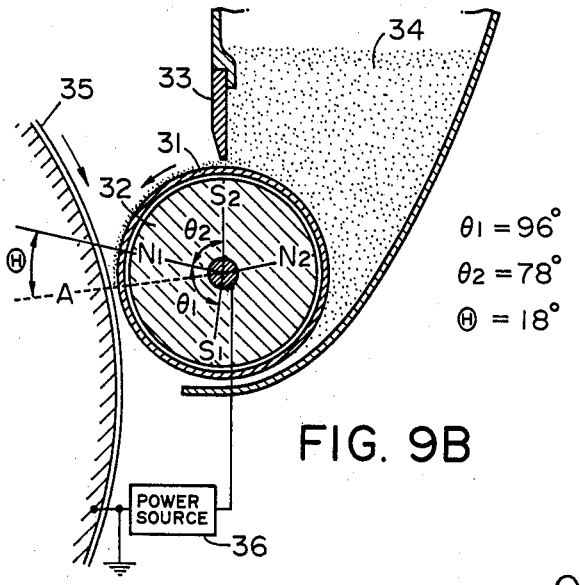
Figure 9C:
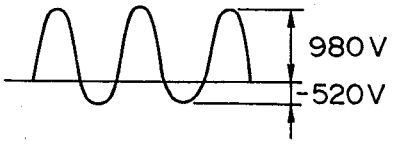
FIG. 9(C) illustrates an example of alternating waveform to be employed in the embodiment shown in FIGS. 9(A) and 9(B).

Referring to FIG. 9 (*a*), 31 is a rotary sleeve encircling a fixed permanent magnet 32, and 33 is a magnetic (iron) blade positioned at a distance of 250 microns from the sleeve surface for defining the application of a toner 34 formed in spherical particles as explained in the foregoing onto said sleeve by means of a magnetic field formed in cooperation with the opposing magnetic pole N1. The toner layer thickness on the sleeve is ca. 80 microns. The magnetic flux density on the surface of the sleeve is 650, 850, 850 or 600 gauss respectively corresponding to the pole S1, N1, S2 or N2.

In the present embodiment there is employed a negative insulating magnetic toner composed of a kneaded and crushed mixture of 68% of a styrene-acrylic resin, 30% of magnetitie and 2% of a negative charge regulant and formed into spherical particles in the aforementioned manner.

35 is a photosensitive drum functioning as the latent image bearing member for holding a positive charge pattern, and is rotated in a same direction and at a substantially same speed with the sleeve. Said sleeve and drum form a developing area in the most closely opposing area thereof, and has a clearance of 300 microns in said developing area.

36 is an external alternating bias supply source which provides a distorted sinusoidal wave of a frequency of 400 Hz and of an amplitude of 1500 $V_{pp}$ as shown in FIG. 9 (*c*) with respect to the grounded backing electrode of the image bearing member, said alternating electric field causing a reciprocating motion of the toner particles in the developing area to effect the image development. The above-explained arrangement provides a satisfactory image with improved tonal rendition, although there is observed certain background fog.

On the other hand a structure shown in FIG. 9 (*b*) provides an extremely good line image without background fog. In said structure the magnetic field at the magnetic blade has a density of 850 gauss as in the case of FIG. 9 (*a*), but the center A of the developing area is displaced, by 18°, from the center of the magnetic pole and has a vertical field density of 350 gauss. Also there is present a horizontal field component which has a density of 500 gauss.

The absence of background fog in this structure is presumably explainable as follows.

Figure 10:
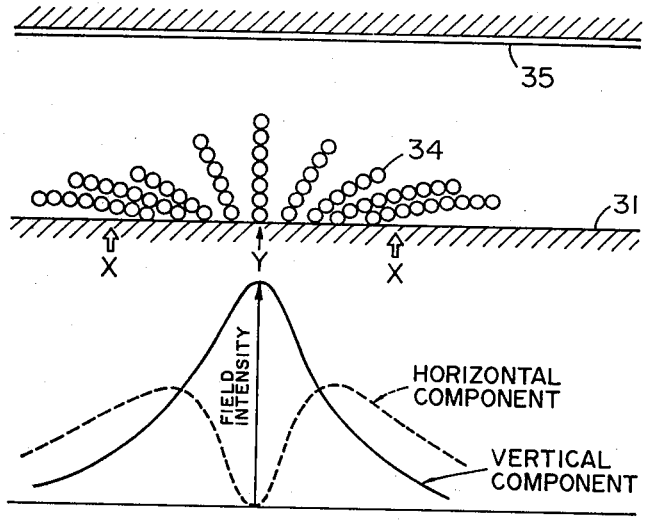
FIG. 10 is an explanatory drawing showing the working principle of the embodiment shown in FIGS. 9(A) and 9(B).

Referring to FIG. 10 schematically showing the toner arrangement in the vicinity of the magnetic pole, Y represents the center of the pole where the magnetic field is composed solely of the vertical component so that the chained toner particles are positioned erect toward the latent image bearing member 35. On the other hand, in a position X displaced from the pole center, there is generated a strong field component so that the chained toner particles lie horizontally along the toner supporting member. For this reason the mutual binding between the toner particles is stronger in the position X to enlarge the field threshold value for causing toner cleavage from the toner supporting member, so that a sufficiently high image density in the high potential area is obtainable by the AC biasing effect while the fog formation in the low potential area is satisfactorily suppressed.

EMBODIMENT 6

Figure 11:
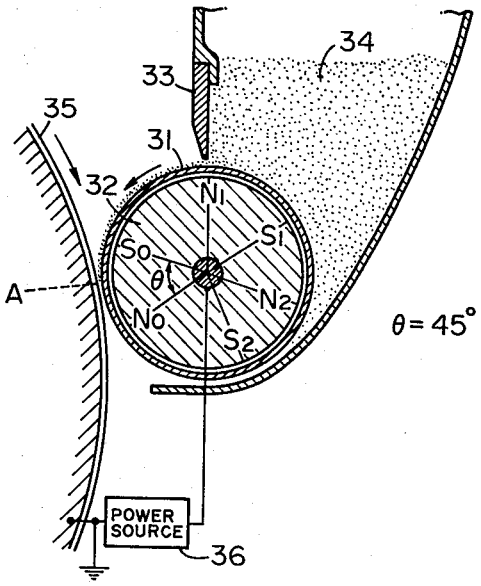
FIG. 11 is a cross-sectional view of still another embodiment of the present invention.

FIG. 11 shows a modified embodiment, in which same components as those in FIGS. 9 (*a*) and 9 (*b*) are represented by same numbers. In the present embodiment the position A is located at the center between two poles So and No of different polarities, which respectively have a vertical magnetic field intensity of 700 gauss, whereby the magnetic field at the position A has a horizontal component of 600 gauss and a vertical component of 0 gauss. The above-explained structure provides an extremely clear fog-free image.

The present invention is by no means limited to the foregoing embodiment but includes any modifications in the scope and spirit of the claimed invention.

What we claim is:

1. A developing method using developer transition from a developer supporting member spaced from a latent image bearing member, comprising the steps of supplying a developer formed in substantially spherical particles to the surface of a developer supporting member, maintaining the developer supporting member in an opposed relationship to the latent image bearing member to provide a clearance between said developer on said developer supporting member and the surface of said latent image bearing member, and applying an alternating electric field to said developer supporting member to cause reciprocating motion of the spherical developer particles between said latent image bearing member and said developer supporting member thereby effecting the image development.

2. A developing method according to claim 1, wherein said method is performed using a microcapsule toner.

3. A developing method according to claim 1, wherein said alternating electric field is a low frequency alternating electric field of a frequency not exceeding 1 kHz.

4. A developing method according to claim 1, satisfying a condition:

$$0.3 \times Vp \leqq f \leqq 1000$$

wherein Vp is the peripheral speed of said latent image bearing member in millimeters per second and f is the frequency of said alternating electric field in Hz.

5. A developing method according to claim 1, wherein a repulsive magnetic field is formed in an area of said developer supporting member opposing to the surface of said latent image bearing member.

6. A developing method according to claim 1, wherein the minimum clearance between said non-magnetic rotary member and said latent image bearing member is larger than the thickness of the developer in said minimum clearance position.

7. A developing method according to claim 1, wherein a magnetic field component parallel to the surface of said developer supporting member is formed in a portion thereof close to the surface of said latent image bearing member.

8. A developing apparatus for image development by developer transition to a latent image from a developer supporting member spaced from a latent image bearing member, comprising:

means for providing the developer supporting member with a developer formed into substantially spherical particles;

means for positioning said developer supporting member in such a manner as to form a space gap between the surface layer of said spherical developer particles supported on said developer supporting member and said latent image bearing member; and means for applying an alternating electric field across said space gap.

9. A developing apparatus according to claim 8, wherein said developer is a microcapsule toner.

10. A developing apparatus according to claim 9, wherein said alternating electric field is a low-frequency electric field of a frequency not exceeding 1 kHz.

11. A developing apparatus for effecting image development comprising:

a non-magnetic rotatable member having a magnet roll therein;

means for forming a layer of substantially spherically shaped magnetic toner particles on an outer surface of said rotatable member;

means for positioning said rotatable member in an opposed relationship to an image bearing member while maintaining a clearance between said layer of magnetic toner and said image bearing member;

means for forming a repulsive magnetic field in the area of said clearance; and means for applying an alternating electric field across said clearance.

12. A developing apparatus for effecting image development comprising;

a non-magnetic rotatable member having a magnet roll therein;

means for forming a layer of substantially spherically shaped magnetic toner particles on an outer surface of said rotatable member;

means for positioning said rotary member in an opposed relationship to an image bearing member while maintaining a clearance between said layer of said magnetic toner and said image bearing member;

further comprising a magnetic pole causing a magnetic field component parallel to the surface of said non-magnetic rotary member in the area of said clearance; and means for applying an alternating electric field across said clearance.

13. A developing apparatus according to claim 12, wherein said developing area is positioned between two poles of different polarities of said magnet.

14. A developing apparatus according to claim 12, wherein said developer is a magnetic developer containing a magnetic material in a proportion of 20 to 50 wt.%, and said parallel field component has an intensity not lower than 300 gauss.

* * * * *